US005299516A

United States Patent [19]

Sakuma

[11] Patent Number: 5,299,516

[45] Date of Patent: Apr. 5, 1994

[54] LOOPER DRIVE MECHANISM OF A SEWING MACHINE

[75] Inventor: Kouichi Sakuma, Yamagata, Japan

[73] Assignee: Suzuki Manufacturing Co., Ltd., Japan

[21] Appl. No.: 906,291

[22] Filed: Jul. 1, 1992

[30] Foreign Application Priority Data

Jul. 15, 1991 [JP] Japan ..... 3-174009

[51] Int. Cl.[5] ..... D05B 1/20; D05B 1/10

[52] U.S. Cl. ..... 112/162; 112/199; 112/200; 112/220; 74/25

[58] Field of Search ..... 112/162, 197, 199, 200, 112/220; 74/25, 50, 55, 567, 569, 570

[56] References Cited

U.S. PATENT DOCUMENTS

| | | | |
|---|---|---|---|
| 2,151,832 | 3/1939 | Bugatti | 74/569 |
| 3,885,509 | 5/1975 | Cox | 112/162 X |
| 3,915,129 | 10/1975 | Rust et al. | 74/569 X |
| 4,022,140 | 5/1977 | Lienemann | 112/220 X |
| 4,690,080 | 9/1987 | Mikuni et al. | 112/162 |
| 4,967,677 | 11/1990 | Seiriki et al. | 112/162 X |
| 5,092,186 | 3/1992 | Frank | 74/55 |

*Primary Examiner*—Clifford D. Crowder
*Assistant Examiner*—Paul C. Lewis
*Attorney, Agent, or Firm*—Lorusso & Loud

[57] ABSTRACT

A looper drive cam is formed of a cylindrical cam which is fixed to a main shaft so that its axis is inclined thereto at an angle of $\theta$. A looper drive fork forming an U-shaped cam follower is attached to a looper drive shaft, and is engaged with the inclined cam. The fork is attached to the looper drive shaft with a degree of freedom which allows for deviation between axes of the main shaft and the looper drive shaft. As the main shaft rotates, a cam face of the inclined cam changes in a range of $\pm\theta$ in a plane containing the main shaft, so that the fork rotates to rotate the looper drive shaft. Owing to the freedom of degree of the fork thus attached, the motion is transmitted smoothly, and wear and rattling are prevented.

8 Claims, 6 Drawing Sheets

LOOPER DRIVE MECHANISM OF A SEWING MACHINE

BACKGROUND OF THE INVENTION

1. Field of the Invention

The invention relates to a looper drive mechanism of a sewing machine, and particularly to a looper drive mechanism for transmitting rotation of a main shaft to a looper.

2. Description of the Background Art

Generally, an overlock machine is provided with one or two loopers, which carry out elliptical or circular motion perpendicular to a path of a linear motion of a needle. The looper is driven by a looper drive shaft, which is perpendicular to a main shaft and is oscillated by a main shaft (drive shaft) of the sewing machine through motion conversion/transmission means such as an eccentric cam, spherical cam and bevel gear. For example, in a looper drive mechanism shown in FIG. 6, a main shaft 100 is provided with a crank 102 to which a link 103 is connected, and a looper drive shaft 104 is connected to the link 103 through an arm 105 and a spherical coupling arm 106. As the main shaft 100 rotates, the link 103 vertically moves, whereby the arm 105 is swung or oscillated to rotate the looper drive shaft 104, which, in turn, oscillates an oscillating arm 107 to drive a looper 108.

However, in the structure employing the spherical cam and spherical arm, manufacturing of the spherical arm itself is difficult and expensive, so that the whole structure becomes expensive.

On the other hand, in the looper drive mechanism employing the eccentric cam, the eccentric cam rotates together with the main shaft and the rotary motion of the eccentric cam caused by the rotation of the main shaft is transmitted through a connecting rod and a spherical arm to the looper drive shaft for driving the looper. In this case, it is necessary to slide the connecting rod relative to the eccentric cam, so that high accuracy cannot be obtained in the motion of the looper, and thus a good seams cannot be obtained. In the structure employing the bevel gear (disclosed, e.g., in the Japanese Laid-Open Patent Publication No. 53-23755 (1978)), the rotary motion of the main shaft, the motion of which is converted by the bevel gear must be further converted by the spur gear, crank, link or the like into the oscillatory motion of the looper drive shaft. This results in a disadvantage that the structures are complicated, the number of parts is large, the assembly and manufacturing are laborious, and consequently the construction is expensive.

In order to solve the disadvantages of the looper drive mechanism in the prior art, there has been proposed a looper drive mechanism employing a groove cam (Japanese Laid-Open Patent Publication No. 62-176487 (1987)). In this looper drive mechanism, as shown in FIG. 7, a coned dram cam 201 provided with grooves 201*a* and 201*b* is attached to a main shaft 200. When the coned dram cam 201 rotates together with the main shaft 200, the oscillation of support arms 204 and 205 for rollers 203*a* and 203*b* engaging the grooves 201*a* and 201*b* are restricted by the grooves 201*a* and 201*b* while the looper drive shafts 206 and 207 are oscillated. This looper drive mechanism requires less number of parts, as compared with the above described looper drive mechanism, and, once a machine for manufacturing the hourglass cam 201 is manufactured, an accurate looper driving operation will be carried out with a simple mechanism.

These looper drive mechanisms in the prior art, however, have such a disadvantage that the assembling operation is time-consuming and laborious, in addition to the respective disadvantages described above. Specifically, in the manufacturing of these looper drive mechanisms, it is necessary to sequentially assemble the cam or gear, looper drive shaft and looper with the main shaft, so that manufacturing steps are complicated, and thus are time-consuming and laborious.

The present invention has been developed in view of these disadvantages of the looper drive mechanisms in the prior art, and it is an object of the invention to provide a looper drive mechanism, in which the number of parts is small, the manufacturing is easy and the accuracy is high.

SUMMARY OF THE INVENTION

A looper drive mechanism of the invention, achieving the above object, includes at least one looper; a looper drive shaft driving the looper; and transmitting means for transmitting rotation of a main shaft to the looper drive shaft, the transmitting means including at least one cylindrical inclined cam fixed to the main shaft, and a U-shaped follower which is carried by the looper drive shaft and has upper and lower surfaces engaging a cam face of the inclined cam directly or through a slide block. The follower is carried by the looper drive shaft such that it has no degree of freedom in a direction parallel to its upper and lower surfaces and has a degree of freedom in a direction perpendicular to its upper and lower surfaces.

When the cylindrical inclined cam rotates together with the main shaft, an angle of an outer surface (cam face) of the inclined cam changes, in a plane containing the main shaft, with respect to the main shaft. The change is caused in a range of $\pm\theta$, wherein $\theta$ is an angle between an axis of the inclined cam and the main shaft. Therefore, the U-shaped follower, of which upper and lower surfaces engage the cam face directly or through the slide block, rotates in a range of the change of the angle, and thus causes the rotation of the looper drive shaft supporting the same to drive the looper mounted on the looper drive shaft. In this case, deviation between the centers of the main shaft and the looper drive shaft is allowed for by the movement of the follower in the direction perpendicular to its upper and lower surfaces.

The foregoing and other objects, features, aspects and advantages of the present invention will become more apparent from the following detailed description of the present invention when taken in conjunction with the accompanying drawings.

DESCRIPTION OF THE PREFERRED EMBODIMENT

An embodiment of a one-needle/three-thread overlock machine to which a looper drive mechanism of the invention is applied will be described below with reference to the drawings.

Figure 1:
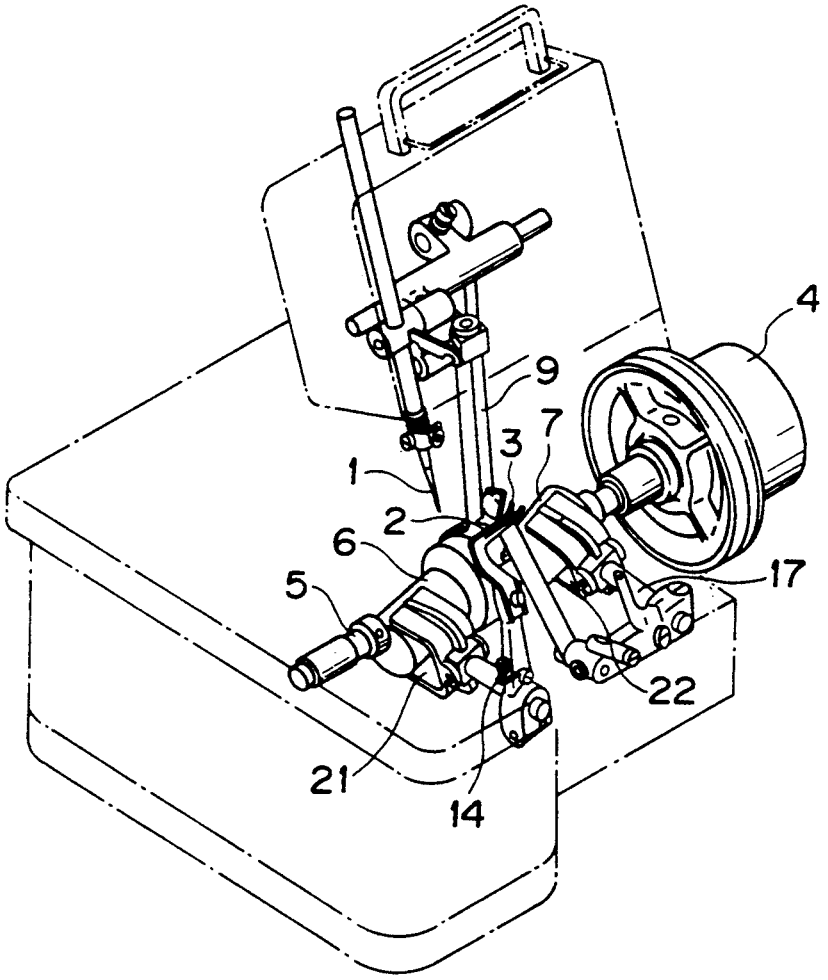
FIG. 1 is a perspective view of a whole over-lock machine to which a looper drive mechanism of the invention is applied.
Figure 2:
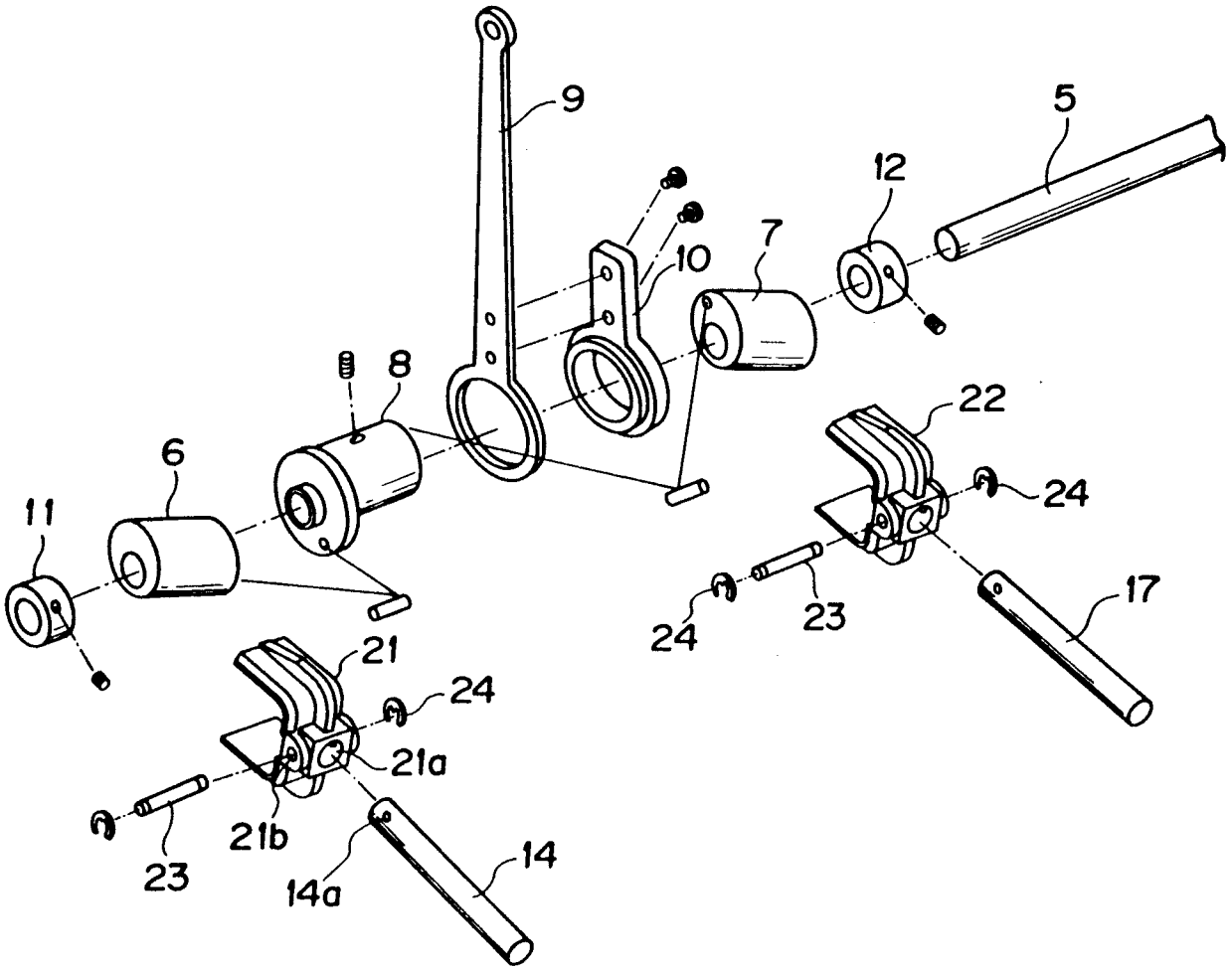
FIG. 2 is an exploded perspective view of a looper drive mechanism of an embodiment of the invention.

FIG. 1 shows the overall structure of the one-needle/three-thread overlock machine including one needle 1, which reciprocates substantially vertically and linearly, a lower looper 2, which circularly reciprocates under a throat plate along an arc-shaped path crossing a path of the needle 1, and an upper looper 3, which elliptically reciprocates above the needle plate along an arc-shaped path crossing the path of the needle 1. Two cylindrical inclined cams, i.e., looper drive cams 6 and 7 corresponding to the upper and lower loopers 2 and 3 are fixed to a main shaft 5 which rotates coaxially to the pulley 4. A needle bar eccentric cam 8 for driving a needle bar in a substantially vertical direction is fixed to the main shaft 5, as shown in FIG. 2, and a needle bar frame rod 9 is fixed to the eccentric cam 8 by means of a mount 10. The looper drive cams 6 and 7 are fixed to the needle rod eccentric cam 8 by connection pins and fixing collars 11 and 12, so that they rotate together with the main shaft 5.

Figure 3:
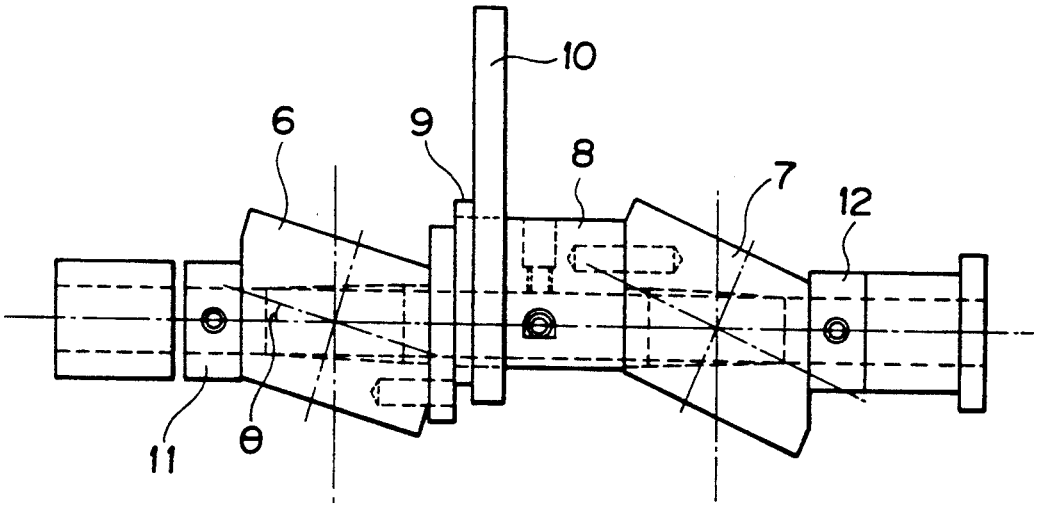
FIG. 3 is a side view showing a looper drive cam of an embodiment of the invention.

Axes of cylinders of the looper drive cams 6 and 7 are inclined through angles of $\theta_1$ and $\theta_2$ to the main shaft 5, respectively, and their positions are determined in accordance with the phase of motion of the upper and lower loopers 3 and 2. Specifically, in the one-needle/-three-thread overlock machine of the embodiment, the upper looper 3 moves relative to the lower looper 2 with deviation corresponding to the rotation angle of the main shaft 5 of about 36 degrees. Correspondingly, the looper drive cam 7 is fixed to the main shaft 5 with a deviation of about 36 degrees relative to the looper drive cam 6. Accordingly, if it is assumed that $\theta_1$ is the maximum value of the angle between the cam face of the looper drive cam 6 and the main shaft 5 in the plane containing the main shaft 5 (i.e., plane of the sheet of FIG. 3) as shown in FIG. 3, the cam face of the looper drive cam 7 forms the maximum angle of $\theta_2$ to the main shaft 5 when the main shaft 5 rotates through 36 degrees.

Figure 4:
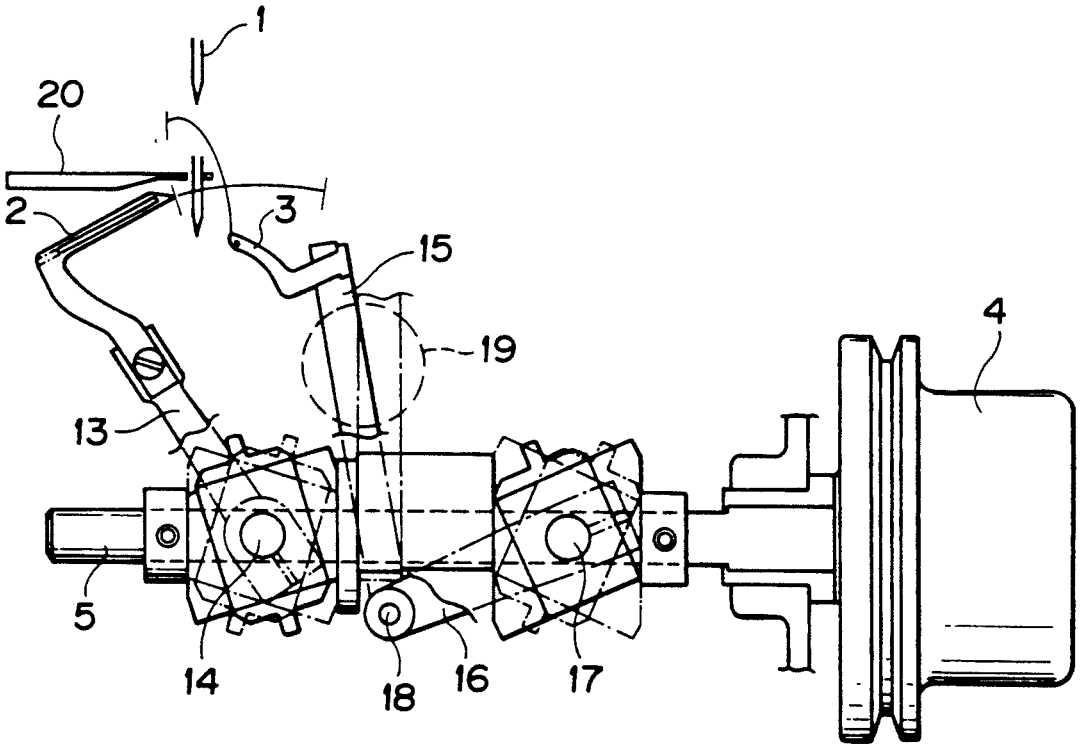
FIG. 4 is a side view of a looper drive mechanism of an embodiment of the invention.

The lower looper 2 is fixed, as shown in FIG. 4, through a lower looper drive arm 13 to a lower looper drive shaft 14. When the lower looper drive shaft 14 rotates, the lower looper 2 circularly reciprocates in a plane (i.e., plane of sheet of FIG. 4) perpendicular to the lower looper drive shaft 14. The upper looper 3 is fixed through an upper looper mounting shaft 15 and an upper looper mounting shaft drive arm 16 to an upper looper drive shaft 17. When the upper looper drive shaft 17 rotates, an end of the upper looper mounting shaft drive arm 16 fixed to the upper looper drive shaft 17 circularly reciprocates. The upper looper mounting shaft 15 is connected to the end of the drive arm 16 through a pin 18, and the motion thereof is restricted by a pivot 19. As the end of the drive arm 16 circularly reciprocates, the upper looper 3 fixed to the end of the arm 16 elliptically reciprocates through a side of a throat plate between the position under the needle plate 20 and a top dead center above the needle plate 20. The looper drive shafts 14 and 17, which drive the lower and upper loopers 2 and 3, respectively, are supported by unillustrated side plates of the sewing machine with their axes perpendicular to the main shaft 5.

Looper drive forks (will be called merely as "forks") 21 and 22, i.e., cam followers for the looper drive cams 6 and 7 are fixed to the looper drive shafts 14 and 17, respectively. The forks 21 and 22 have the same structures, and thus only the fork 21 will be described below. The fork 21 is formed of an U-shaped member having two parallel and opposed upper and lower surfaces, which engage the looper drive cam 6, so that the inclination of the cam face changes in accordance with the rotation of the looper drive cam 6, whereby the fork 21 oscillates to rotate the looper drive shaft 14. The fork 21 and the looper drive shaft 14 are connected in a manner shown in FIG. 2, in which the looper drive shaft 14 is fitted into a hole **21*a* which has a diameter slightly larger than the outer diameter of the drive shaft 14 and is formed at the center of the fork 21. A fixing pin 23 is fitted into a hole 14*a* in the looper drive shaft 14 and a hole 21*b* in the fork 21 to support the looper drive shaft 14 by the fork 21, and this fixing pin 23 is fixed to the fork 21 by an E-shaped ring 24. Thereby, the fork 21 has no degree of freedom in a direction parallel to the fixing pin 23, i.e., a direction parallel to its upper and lower surfaces, and has a degree of freedom in a direction perpendicular to the upper and lower surfaces. Therefore, even if a slight deviation exists between the axes of the main shaft 5 and the looper drive shaft 14 due to the limit of assembly accuracy of the sewing machine, the fork 21 cancels this deviation by its rotation in the direction perpendicular to the upper and lower surfaces when the fork 21 engages the looper drive cam 6, so that the motion can be smoothly transmitted between the looper drive cam 6, fork 21 and looper drive shaft 14**.

When assembling this looper drive mechanism, the needle rod eccentric cam 8, needle rod frame rod 9 and mount 10 are fixed to the main shaft 5 on the body of the sewing machine, and the looper drive cams 6 and 7 are fixed thereto by the fixing collars 11 and 12, whereby the assembly of the main shaft 5 is completed. In a different step, the looper drive shafts 14 and 17, to which the looper drive forks 21 and 22 are fixed, as well as the pivot 19 are attached to the side plates of the sewing machine, and the lower looper drive arm 13 to which the lower looper 2 is fixed is attached to the looper drive shaft 14. The upper looper mounting shaft 15, to which the upper looper 3 and the upper looper mounting shaft drive arm 16 are attached, is attached to the looper drive shaft 17 and pivot 19, whereby the assembly including the side plates of the sewing machine is completed. After forming the assembly of the main shaft 5 and the assembly of the side plates of the sewing machine in this manner, the assembly of the side plates of the sewing machine is attached to the body of the machine so that the looper drive forks 21 and 22 engage the looper drive cams 6 and 7, respectively. Therefore, the assembly operation can be extremely easy and the time required for the assembly can be significantly reduced.

Operation of the looper drive mechanism thus constructed will be described below.

As the main shaft 5 rotates, and thus the looper drive cams 6 and 7 rotate, the inclination of the cam faces of the looper drive cams 6 and 7 change in the ranges of $\pm\theta_1$ and $\pm\theta_2$ in the planes which contain the main shaft 5 and are perpendicular to the looper drive shafts 14 and 17, respectively. Thereby, the looper drive forks 21 and 22 engaging the cam faces oscillate, and thus the lower looper drive shaft 14 and the upper looper drive shaft 17 oscillate in the ranges of $\pm\theta_1$ and $\pm\theta_2$ in accordance with this oscillation.

The rotation of the lower looper drive shaft 14 is transmitted through the lower looper drive arm 13 to the lower looper 2 without any conversion, and the lower looper 2 circularly reciprocates in the plane perpendicular to the lower looper drive shaft 14. Meanwhile, when the upper looper drive shaft 17 rotates, the end of the upper looper mounting shaft drive arm 16 circularly reciprocates to drive the upper looper mounting shaft 15 connected thereto in a substantially vertical direction. The end of the upper looper mounting shaft 15 thus driven carries out the elliptical reciprocation, which is restricted by the pivot 19. Thus, the upper looper 3 elliptically reciprocates.

For example, when the main shaft 5 is at the rotary position of 0 degree, the cam face of the looper drive cam 6 is inclined at the maximum degree of $+\theta_1$. In this condition, the lower looper 2 is in the right end position in FIG. 4. When the main shaft 5 is in the rotary position of 180 degrees, the cam face of the looper drive cam 6 is in the position of $-\theta_1$, and the lower looper 2 is in the left end position in FIG. 4. Meanwhile, the phase of the upper looper 3 is shifted by about 35 degrees. When the main shaft 5 is in the rotary position of 36 degrees, the cam face of the looper drive cam 7 is inclined at the maximum angle of $+\theta_2$, and the upper looper 3 is in the top dead center in FIG. 4. When the main shaft 5 is in the rotary position of 180+36 degrees, the cam face of the looper drive cam 7 is in the position of $-\theta_2$, and the upper looper 3 is in the bottom dead center in FIG. 4.

Figure 5B:
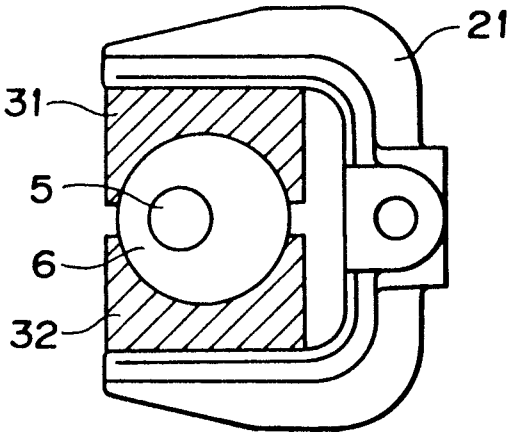
FIG. 5 shows a looper drive mechanism of another embodiment of the invention.
Figure 5A:
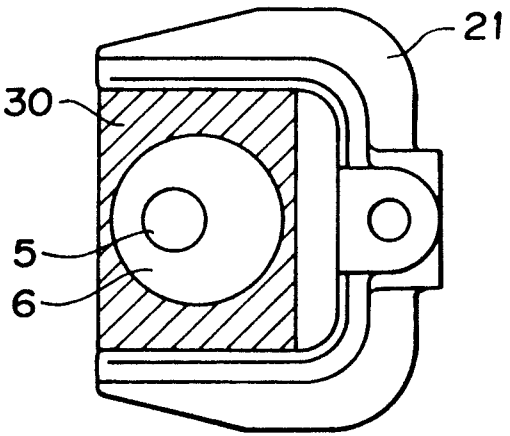
Figure 6:
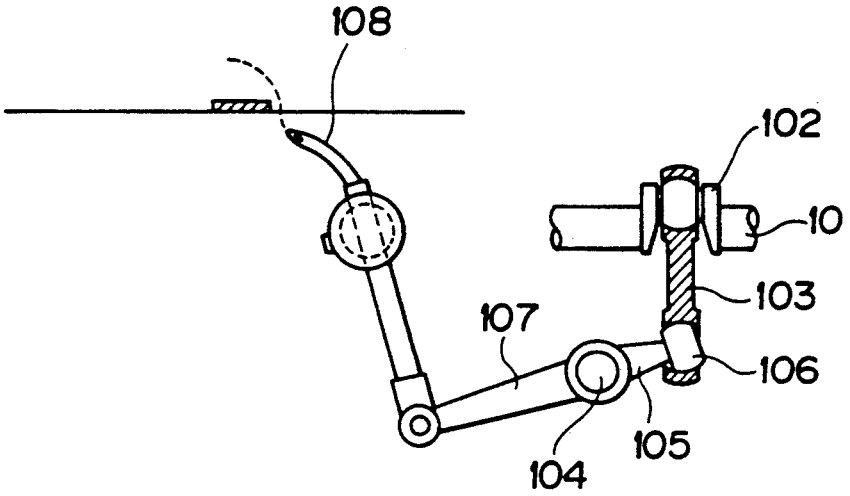
FIG. 6 (PRIOR ART)
FIG. 6 shows a looper drive mechanism in the prior art.
Figure 7:
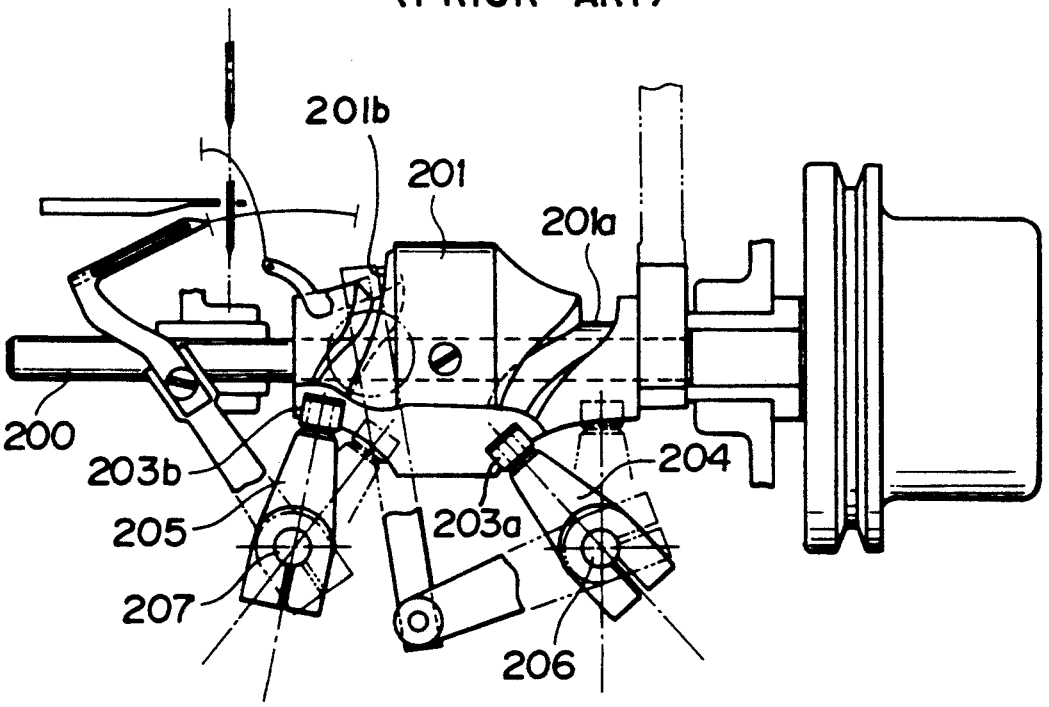
FIG. 7 (PRIOR ART)
FIG. 7 shows a looper drive mechanism using a coned dram cam in the prior art.

In the embodiment described above, the followers, i.e., looper drive forks directly engage the cylindrical inclined cams, i.e., looper drive cams. As shown in FIG. 5(*a*), however, a slide block, i.e., a circular block 30 may be rotatably fitted onto the looper drive cam 5 (6) and the upper and lower surfaces of the looper drive fork 21 (22) may be engaged with the side surfaces of the square block 30 opposed thereto. In this embodiment, since the side surfaces of the square block 30 contact the upper and lower surfaces of the looper drive fork 21 (22) through a plane, the wear resistance is improved, as compared with the embodiment in which the fork directly engages the looper drive cam through a linear contact area. The slide block may be formed of two separated members 31 and 32, as shown in FIG. 5(*b*).

Further, in the embodiment described above, the needle 1 reciprocates in a direction slightly inclined with respect to the vertical direction, and the upper looper 3 moves in the vertical plane. In other words, the upper looper drive shaft 17 is perpendicular to the vertical plane. The present invention, however, may have a plane for motion of the upper looper 3 which is not vertical due to the relationship to the motion of the needle 1. Also, in such an embodiment, the upper looper drive shaft 17 is disposed perpendicularly to the plane of motion of the upper looper 3.

Although the present invention has been described with respect to the three-thread overlock machine, the looper drive mechanism of the invention can be also applied to any sewing machines, other than the overlock machines, having one or more loopers.

As can be seen from the embodiments described hereinabove, in the looper drive mechanism of the invention, the looper drive shaft can be driven by the cam follower which directly engages the cam fixed to the main shaft. Therefore, the number of parts and components can be remarkably reduced, as compared with the conventional looper drive mechanism. Further, the cam follower has a degree of freedom, which allows for deviation between the main shaft and the looper drive shaft, so that the transmission of the motion does not cause a load to be applied to each member, and thus the wear is prevented and the looper can be driven with a high accuracy.

Since the looper drive mechanism of the invention enables the assembly of the sewing machine body to which the main shaft which is attached and the assembly of the side plates of the sewing machine to which the looper is attached in independent steps, the assembly operation is very easy, and the time required for the assembling operation can be remarkably reduced.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A looper drive mechanism for a sewing machine having a main shaft rotatable about a central axis, said mechanism comprising at least one looper, a looper drive shaft driving said looper, and transmitting means for transmitting rotation of the main shaft to said looper drive shaft, said transmitting means including at least one cylindrical inclined cam on the main shaft, said inclined cam having a central axis inclined with respect to the central axis of said main shaft and a cam face inclined with respect to the central axis of the main shaft, and an U-shaped follower which is carried by said looper drive shaft and has upper and lower surfaces linearly contacting the cam face of said inclined cam.

2. A looper drive mechanism for a sewing machine having a main shaft rotatable about a central axis, said mechanism comprising, at least one looper, a looper drive shaft driving said looper, and transmitting means for transmitting rotation of the main shaft to said looper drive shaft, said transmitting means including at least one cylindrical inclined cam fixed to the main shaft, said inclined cam having a central axis and a cam face both inclined with respect to the main shaft, a slide block rotatably engaging said inclined cam, and an U-shaped follower which is carried by said looper drive shaft and has upper and lower surfaces contacting side surfaces of said slide block.

3. A looper drive mechanism for a sewing machine as claimed in claim 1, wherein said follower is carried by said looper drive shaft so that said follower has no degree of freedom in a direction parallel to said upper and lower surfaces and has a degree of freedom in a direction perpendicular to said upper and lower surfaces.

4. A looper drive mechanism for a sewing machine as claimed in claim 2, wherein said follower is carried by said looper drive shaft so that said follower has no degree of freedom in a direction parallel to said upper and lower surfaces and has a degree of freedom in a direction perpendicular to said upper and lower surfaces.

5. A looper drive mechanism for a sewing machine as claimed in claim 1, further comprising an additional looper and an additional looper drive shaft for driving said additional looper and an additional inclined cam mounted on said main shaft, said additional inclined cam having a central axis and a cam face both inclined with respect to said main shaft, and an additional U-shaped follower carried by said additional looper drive shaft and having upper and lower surfaces linearly contacting the cam face of said additional inclined cam.

6. A looper drive mechanism for a sewing machine as claimed in claim 2, further comprising an additional looper and an additional looper drive shaft for driving said additional looper and an additional inclined cam mounted on said main shaft, said additional inclined cam having a central axis and a cam face both inclined with respect to said main shaft, and an additional U-shaped follower carried by said additional looper drive shaft and having upper and lower surfaces linearly contacting the cam face of said additional inclined cam.

7. A looper drive mechanism as claimed in claim 1, wherein the cam face is a smooth cylindrical surface.

8. A looper drive mechanism as claimed in claim 2, wherein the cam face is a smooth cylindrical surface.

* * * * *